US006733205B2

(12) United States Patent
Brown et al.

(10) Patent No.: US 6,733,205 B2
(45) Date of Patent: May 11, 2004

(54) GUARDRAIL DELINEATORS

(75) Inventors: Gregory H. Brown, Stow, OH (US); Charles D. Bailey, Brecksville, OH (US)

(73) Assignee: Plastic Safety Systems, Inc., Cleveland, OH (US)

( * ) Notice: Subject to any disclaimer, the term of this patent is extended or adjusted under 35 U.S.C. 154(b) by 0 days.

(21) Appl. No.: 09/992,442

(22) Filed: Nov. 14, 2001

(65) Prior Publication Data

US 2003/0091387 A1 May 15, 2003

(51) Int. Cl.[7] ..... E01F 9/00
(52) U.S. Cl. ..... 404/9; 116/63 R; 40/612
(58) Field of Search ..... 404/9, 6, 14, 16; 116/63 R, 173, 175; 40/606, 607, 612; D10/113; 359/552; D25/199; 256/13.1

(56) References Cited

U.S. PATENT DOCUMENTS

| | | | | | |
|---|---|---|---|---|---|
| 2,167,564 | A | * | 7/1939 | Fonda | 248/407 |
| 2,193,747 | A | * | 3/1940 | Thompson | 116/175 |
| 2,229,335 | A | * | 1/1941 | Moorman | 248/466 |
| 2,318,722 | A | * | 5/1943 | Smith et al. | 359/552 |
| 3,680,448 | A | * | 8/1972 | Ballingall et al. | 116/63 R |
| 3,863,595 | A | * | 2/1975 | Barnett et al. | 116/63 R |
| D236,818 | S | | 9/1975 | Stonemann | |
| 4,092,081 | A | * | 5/1978 | Schmanski | 404/10 |
| 4,569,495 | A | * | 2/1986 | Woudenberg et al. | 248/160 |
| 4,645,168 | A | | 2/1987 | Beard | |
| 4,686,785 | A | * | 8/1987 | Obbermito | 40/602 |
| 4,723,758 | A | * | 2/1988 | Gehrig | 256/13.1 |
| 4,783,921 | A | | 11/1988 | George | |
| 4,991,994 | A | | 2/1991 | Edouart | |
| 5,218,775 | A | * | 6/1993 | Singer | 40/605 |
| 5,255,995 | A | * | 10/1993 | Branning | 404/14 |
| D393,425 | S | * | 4/1998 | Weid | D10/111 |
| 5,788,405 | A | | 8/1998 | Beard | |
| 5,848,502 | A | * | 12/1998 | Schaefer | 248/156 |
| 5,950,992 | A | * | 9/1999 | Weid | 256/13.1 |
| 6,233,898 | B1 | * | 5/2001 | Burlando | 116/63 P |
| D443,308 | S | | 6/2001 | Kovell | |
| D445,054 | S | * | 7/2001 | Despino et al. | D10/113 |
| 6,516,573 | B1 | * | 2/2003 | Farrell et al. | 52/98 |

FOREIGN PATENT DOCUMENTS

| | | | |
|---|---|---|---|
| EP | 0 412 890 | * | 8/1990 |

* cited by examiner

*Primary Examiner*—Gary S. Hartmann
(74) *Attorney, Agent, or Firm*—Renner, Otto, Boisselle & Sklar, LLP

(57) ABSTRACT

Guardrail delineators include a flag portion and a depending leg portion. One side edge of the leg portion has a notch axially spaced from the flag portion. The top surface of the notch is engageable with a top edge of the guardrail or a top edge of the support structures for the guardrail for positioning the flag portion a predetermined height above the guardrail. The one side edge of the leg portion axially outwardly of the notch extends perpendicular from the inner end of the notch and is engageable with the back side of the guardrail or support structures for providing proper vertical alignment of the delineators with respect to the guardrail.

15 Claims, 2 Drawing Sheets

GUARDRAIL DELINEATORS

FIELD OF THE INVENTION

This invention relates to delineators for delineating guardrail during the day and at night or under adverse weather conditions.

BACKGROUND OF THE INVENTION

Current guardrail delineators are difficult to install and are not very durable. They are typically either mounted on the guardrail mounting bolts used to attach the guardrail to guardrail anchor supports or on the guardrail anchor supports themselves. Mounting the guardrail delineators on the guardrail mounting bolts has the drawback that the mounting bolts must be loosened to insert guardrail delineator brackets behind the bolt heads within the guardrail channel and then retightened. Also, when snow plows plow the road, oftentimes snow gets packed into the guardrail channel, covering the delineators.

When the delineators are mounted on the guardrail anchor supports, the delineators are generally positioned too far back from the guardrail. Also, the delineators are typically clipped or glued onto the top edge of the guardrail anchor supports where they are easily knocked off.

SUMMARY OF THE INVENTION

The guardrail delineators of the present invention are easier to install and have greater durability than previous guardrail delineators.

In accordance with one aspect of the invention, the guardrail delineators include a flag portion and a depending leg portion having one side edge with a notch axially spaced from the flag portion to allow an installer to easily maintain vertical and horizontal alignment of the flag portion with respect to the guardrail. By properly positioning the notch against the top edge of the guardrail or support structures therefor with the one side edge of the leg portion axially outwardly of the notch engaging the back side of the guardrail or support structures, the delineators are automatically correct for both vertical and horizontal alignment.

In accordance with another aspect of the invention, the leg portions of the delineators are secured to a flat surface on the guardrail anchor supports or associated spacer blocks as by means of lag bolts, screws, nails, tape or glue, giving the delineators added strength and making them harder to knock off.

In accordance with another aspect of the invention, the flag portions of the delineators extend outwardly to the outside edge of the guardrail.

In accordance with another aspect of the invention, the flag portion of the delineators are sized to suit a particular application.

These and other objects, advantages, features and aspects of the present invention will become apparent as the following description proceeds.

To the accomplishment of the foregoing and related ends, the invention, then, comprises the features hereinafter fully described and particularly pointed out in the claims, the following description and the annexed drawings setting forth in detail certain illustrative embodiments of the invention, these being indicative, however, of but several of the various ways in which the principles of the invention may be employed.

DETAILED DESCRIPTION OF THE INVENTION

Figure 1:
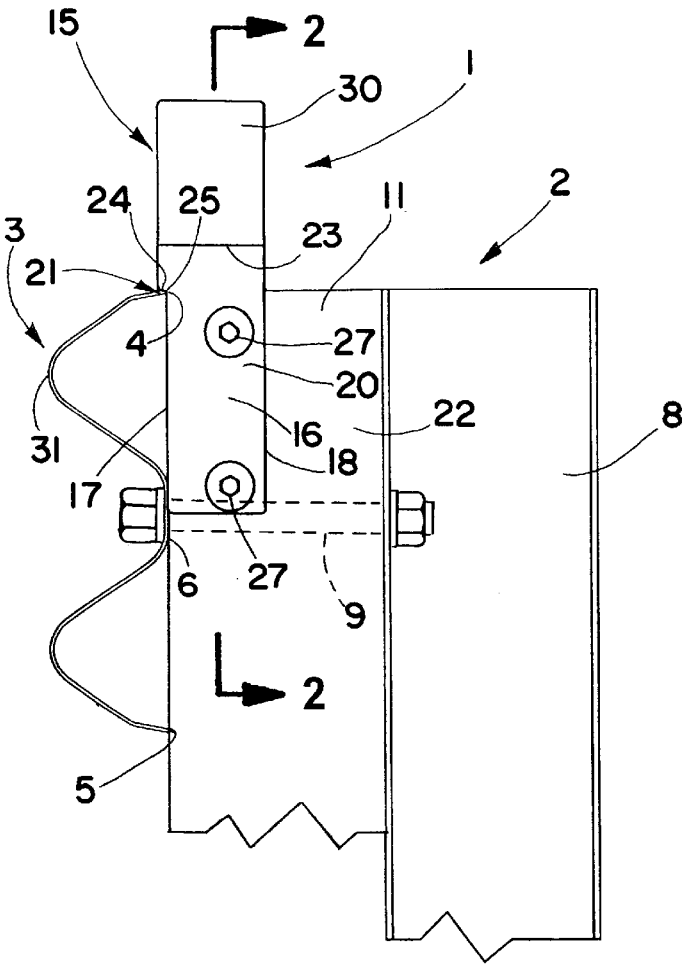
FIG. 1 is a fragmentary side elevation view showing one form of guardrail delineator in accordance with this invention having a notch in one side edge of the leg portion of the delineator engaging the top edge of the guardrail and the one side edge of the delineator axially outwardly of the notch engaging the back side of the guardrail.
Figure 2:
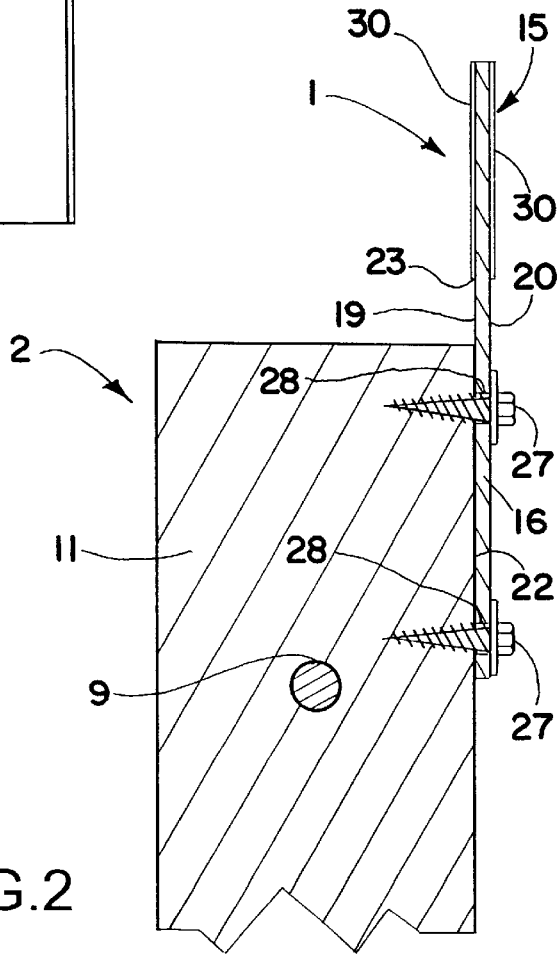
FIG. 2 is an enlarged fragmentary vertical section through the guardrail delineator and spacer block of FIG. 2, taken generally on the plane of the line 2—2 thereof.

Referring now in detail to the drawings, and initially to FIGS. 1 and 2, there is shown one form of guardrail delineator 1 in accordance with this invention attached to a support structure 2 for a guardrail 3 as described hereafter. Guardrail 3 is typically made of steel and includes top and bottom edges 4 and 5 and an intermediate channel 6 all in vertical alignment with one another. The guardrail is supported off the ground by anchor posts 8 driven into the ground every ten feet or so. These anchor posts may be made of wood or steel as desired, and have the guardrail 3 attached thereto by bolts 9 extending through the guardrail channel 6 into the posts as schematically shown in FIGS. 1 and 2. Also, spacer blocks 11 made of wood, plastic or steel may be placed between the guardrail 3 and posts 8 for maintaining a desired spacing therebetween as further shown in FIGS. 1 and 2.

Each delineator 1 is desirably a one-piece die cut or molded plastic part but could also be made of metal or other suitable material, and includes a flag portion 15 having an integral leg portion 16 depending therefrom. Leg portion 16 has oppositely facing side edges 17, 18 and opposite flat sides 19, 20 connected together by such side edges (see FIG. 2). In the side edge 17 of leg portion 16 axially outwardly spaced from flag portion 15 is a notch 21 having a planar top surface 24 that is engageable with the top edge 4 of the guardrail 3 with one side 19 of leg portion 16 engaging a flat side 22 of spacer block 11. The vertical height of the flag portion 15 above the guardrail 3 will be determined by the vertical distance between the bottom edge 23 of the flag portion 15 and the top surface 24 of the notch.

The side edge 17 of leg portion 16 axially outwardly of the notch extends perpendicularly relative to the planar top surface 24 from the inner end 25 of the notch all the way to the outer end of the leg portion as schematically shown in FIG. 1. Accordingly, when the top edge 4 of the guardrail 3 is properly positioned in the notch 21 and the side edge 17 of the delineator axially outwardly of the notch is fitted up against the back side of the guardrail channel 6 as shown in FIG. 1, the delineator will automatically be positioned for both vertical and horizontal alignment of the delineator with respect to the guardrail. Once the delineator has been properly positioned, the flat side 19 of the leg portion 16 of the delineator may be attached to the adjacent flat side 22 of the spacer block 11 using suitable fasteners 27 such as bolts, screws, nails, glue or double-sided tape. Also, vertically spaced predrilled holes 28 (see FIG. 2) may be provided in the leg portion 16 of delineator 1 axially outwardly of the notch 21 to facilitate such attachment using screws or nails an the like.

Figure 3:
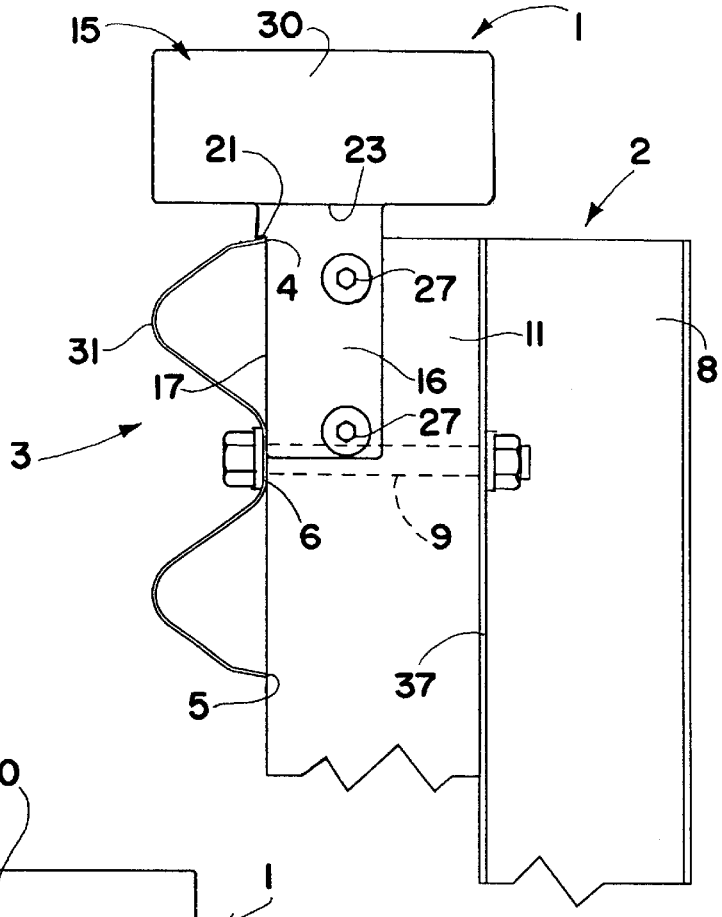
FIG. 3 is a fragmentary side elevation view similar to FIG. 1 but showing another form of guardrail delineator in accordance with this invention which is substantially the same as the guardrail delineator of FIG. 1 except that the flag portion extends both rearwardly and forwardly of the leg portion with the one side edge of the flag portion in substantial vertical alignment with the outside edge of the guardrail.

Retroreflective pressure sensitive sheeting 30 or the like may be applied to both sides of the delineator flag portion 15 in order to better delineate the guardrail 3 at night or under adverse weather conditions. Also, the width of the flag portion 15 may be made to extend out to the outside edge 31 of the guardrail as shown in FIG. 3 to mark the exact location of such outside edge.

Figure 4:
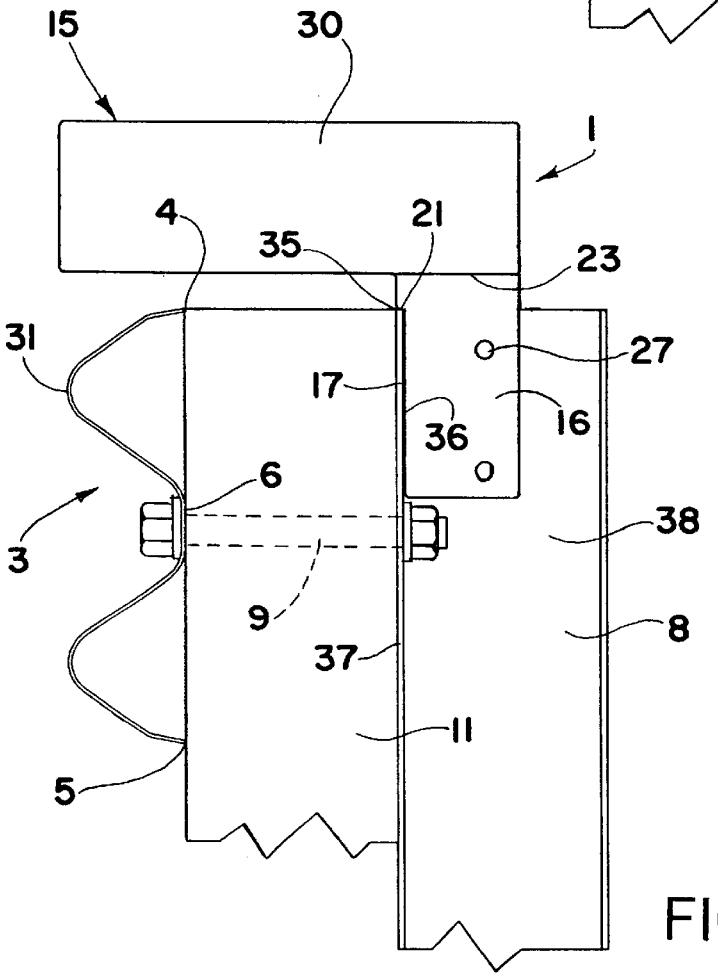
FIG. 4 is a fragmentary side elevation view showing another form of guardrail delineator in accordance with this invention in which the notch in the one side edge of the leg portion engages the top edge of a guardrail mounting post and the flag portion extends forwardly beyond the leg portion with the one side edge of the flag portion in substantial vertical alignment with the outside edge of the guardrail.

The anchor posts 8 may for example be wooden posts, similar to spacer block 11, or metal I-beams. Where the anchor posts 8 are I-beams, the delineator 1 may, if desired, be positioned with the notch 21 in the side edge 17 of leg portion 16 engaging the top front edge 35 of the I-beam and the side edge 17 of the leg portion axially outwardly of the notch engaging the vertical side 36 of the front leg 37 of the I-beam as schematically shown in FIG. 4 to provide proper vertical and horizontal alignment of the delineator with respect to the guardrail. In this embodiment, the leg portion 16 of the delineator 1 is attached to one side of the center wall 38 of the I-beam using a suitable fastener such as lag bolts, glue or double-sided tape. Also in this embodiment, the width of the flag portion 15 which is covered by the retroreflective sheeting 30 is desirably made to extend all the way out to the outside edge 31 of the guardrail as further shown in FIG. 4. Moreover, the width of the flag portion 15 may extend rearwardly of the leg portion 16 as well as forwardly thereof as schematically shown in FIG. 3. Guardrail delineators 1 with wider flag portions 15 would typically be used where more visibility is needed, for example, on curved sections of highway or on cloverleafs, to provide more information to the driver as to the exact location of the guardrail relative to the driver's position.

From the foregoing, it will be apparent that the guardrail delineators of the present invention provide an economical, durable and extremely effective method of delineating guardrail both night and day. Also, installation is made simple by providing the leg portion of the delineators with a notched profile that allows an installer to easily maintain both vertical and horizontal alignment of the delineators.

Although the invention has been shown and described with respect to certain embodiments, it is obvious that equivalent alterations and modifications will occur to others skilled in the art upon the reading and understanding of the specification. In particular, with regard to the various functions performed by the above described components, the terms (including any reference to a "means") used to describe such components are intended to correspond, unless otherwise indicated, to any component which performs the specified function of the described component (e.g., that is functionally equivalent), even though not structurally equivalent to the disclosed component which performs the function in the herein exemplary embodiments of the invention. In addition, while a particular feature of the invention may have been disclosed with respect to only one embodiment, such feature may be combined with one or more other features of other embodiments as may be desired and advantageous for any given or particular application.

What is claimed is:

1. In combination, a guardrail having a plurality of spaced apart support structures for supporting said guardrail above ground level, and guardrail delineators for delineating said guardrail, each of said delineators comprising a flag portion and a leg portion depending axially outwardly from said flag portion, said leg portion having oppositely facing side edges, and a notch in one of said side edges axially outwardly spaced from said flag portion, said notch having a planar top surface engaging a top edge of one of said guardrail and said support structures for positioning said flag portion a predetermined height above said guardrail, said top surface of said notch having an inner end, and said one side edge of said leg portion axially outwardly of said notch extending from said inner end of said notch perpendicularly relative to said planar top surface and engaging a back side of one of said guardrail and said support structures for providing proper vertical alignment of said delineator with respect to said guardrail.

2. The combination of claim 1 wherein said leg portion has a flat side attached to a flat side of said support structures.

3. The combination of claim 2 comprising a plurality of spaced apart holes extending through opposite sides of said leg portion axially outwardly of said notch, and fasteners extending through said holes into said support structures for attaching said leg portion to said support structures with said flat side of said leg portion engaging said flat side of said support structures.

4. The combination of claim 1 wherein said top surface of said notch engages said top edge of said guardrail and said one side edge of said leg portion axially outwardly of said notch engages the back side of said guardrail.

5. The combination of claim 4 wherein said flag portion extends forwardly beyond said leg portion in substantial vertical alignment with an outside edge of said guardrail.

6. The combination of claim 1 wherein said support structures comprise vertical I-beams, and said top surface of said notch engages a top front edge of said I-beams and said one side edge of said leg portion axially outwardly of said notch engages a vertical side of a front leg of said I-beams.

7. The combination of claim 6 wherein said flag portion extends forwardly of said one side edge of said leg portion in substantial vertical alignment with an outside edge of said guardrail.

8. The combination of claim 1 wherein said flag portion and said leg portion axially inwardly of said notch are the same width.

9. The combination of claim 1 wherein said flag portion has a greater width than said leg portion axially inwardly of said notch.

10. A guardrail delineator comprising a flag portion and a leg portion depending axially outwardly from said flag portion, said leg portion having opposite sides connected together by oppositely facing side edges, and a notch in one of said side edges axially outwardly spaced from said flag portion, said notch having a planar top surface for engaging a top edge of one of a guardrail and a support structure for the guardrail for positioning said flag portion a predetermined height above said guardrail, said top surface of said notch having an inner end from which said one side edge of said leg portion axially outwardly of said notch extends perpendicularly relative to said planar top surface for engaging a back side of one of the guardrail and the support structure for providing proper vertical alignment of the delineator with respect to the guardrail, said flag portion extending forwardly of said inner end of said notch a distance corresponding to the width of said guardrail.

11. The delineator of claim 10 wherein said flag portion extends forwardly and rearwardly of said leg portion.

12. The delineator of claim 10 further comprising a plurality of spaced apart mounting holes extending through opposite sides of said leg portion axially outwardly of said notch.

13. The delineator of claim 10 wherein said opposite sides of said leg portion and opposite sides of said flag portion are flat and in the same respective planes.

14. The delineator of claim 10 wherein said leg portion is integral with said flag portion.

15. The delineator of claim 14 wherein said flag portion and said leg portion comprise a single plastic piece.

* * * * *